US005655650A

United States Patent [19]

Naitou

[11] Patent Number: 5,655,650

[45] Date of Patent: Aug. 12, 1997

[54] PUSH BUTTON SWITCH

[75] Inventor: Kiyotaka Naitou, Yokkaichi, Japan

[73] Assignee: Sumitomo Wiring Systems, Ltd., Japan

[21] Appl. No.: 280,002

[22] Filed: Jul. 25, 1994

[30] Foreign Application Priority Data

Aug. 9, 1993 [JP] Japan ..... 5-218039

[51] Int. Cl.[6] ..... H01H 21/00

[52] U.S. Cl. ..... 200/553; 200/561; 200/339; 200/512; 200/513; 200/517

[58] Field of Search ..... 200/553, 513, 200/521, 515, 520, 512, 557, 61.27, 339, 517, 547, 551, 561, 552, 5 R, 5 E, 5 A

[56] References Cited

U.S. PATENT DOCUMENTS

| | | | |
|---|---|---|---|
| 4,654,488 | 3/1987 | Westfall | 200/552 |
| 4,851,626 | 7/1989 | Nagashima | 200/513 |
| 5,115,108 | 5/1992 | Ogawa et al. | 200/113 |
| 5,412,165 | 5/1995 | Malone et al. | 200/5 R |
| 5,426,275 | 6/1995 | Maeda et al. | 200/5 R |

FOREIGN PATENT DOCUMENTS

| | | | |
|---|---|---|---|
| 235880 | 9/1987 | European Pat. Off. | H01H 23/02 |
| 509368 | 10/1992 | European Pat. Off. | H01H 13/48 |
| 3020010 | 12/1981 | Germany | H01H 13/14 |
| 4104572 | 8/1991 | Germany | H01H 9/04 |
| 76443 | 5/1987 | Japan | H01H 13/52 |
| 76442 | 5/1987 | Japan | H01H 13/52 |

*Primary Examiner*—David J. Walczak

*Attorney, Agent, or Firm*—Jordan B. Bierman; Bierman, Muserlian and Lucas LLP

[57] ABSTRACT

There is disclosed a push button switch which comprises rubber contacts each including a contact portion (311), a flared portion (312) formed integrally with the periphery of the contact portion (311), and a ring-shaped portion (313) formed integrally with a lower end of the flared portion (312) and disposed on a printed board (1) wherein the following relation is satisfied: $0.3 \leqq d/a \leqq 0.7$, $4 \leqq d/t \leqq 6$, $1.0 \leqq d/h \leqq 1.4$, $150° \leqq \theta \leqq 165°$, $1.5 \leqq h \leqq 3$ where t is the thickness of the flared portion (312), d is the length of the flared portion (312), a is an inner diameter of the ring-shaped portion (313), θ is an opening angle formed by an inner side surface of the flared portion (312) and a top surface of the printed board (1), and h is the distance between a bottom surface of a conductor (32) and the top surface of the printed board (1). Only the rubber contacts provide a sufficient operational load and a clear click feeling required for a vehicle-mounted switch without using the conventional spring and sliding element. This accomplishes an inexpensive, small-sized vehicle-mounted push button switch.

5 Claims, 2 Drawing Sheets

PUSH BUTTON SWITCH

BACKGROUND OF THE INVENTION

1. Field of the Invention

The present invention relates to a push button switch for use in VTRs, audio equipments, wireless equipments, copiers, telephones and the like and particularly suitable as a vehicle-mounted switch such as an automotive power window switch.

2. Description of the Prior Art

In the past, rubber contacts for push button switches have offered the advantages of providing a stabilized switching condition as compared with mechanical type contacts, being excellent in chattering characteristic, and being inexpensive, and thus have been used in various applications including VTRs, audio equipments, wireless equipments, copiers, telephones and the like.

However, a small number of rubber contacts have been used in vehicle-mounted push button switches for the reason that an operating feeling required for the vehicle-mounted push button switches is not provided, that is, the following requirements are not met: (i) a high load and a long stroke for prevention of malfunction; and (ii) a high load, a long stroke, and a clear click feeling enough for an operator to recognize switching.

To attain such an operating feeling, the use of a spring and the like in combination with the rubber contacts has conventionally been considered as shown in FIG. 3.

Referring to FIG. 3, two insulative rubber contacts 2*a* and 2*b* are arranged laterally in position on a printed board 1 on which a copper foil pattern is formed and various electronic parts are mounted. A case 3 includes left and right bosses 4*a* and 4*b* of tubular configuration in positions corresponding respectively to the rubber contacts 2*a* and 2*b*. The case 3 is disposed on the printed board 1 so that the rubber contacts 2*a* and 2*b* are positioned within the bosses 4*a* and 4*b*, respectively. Columnar pushing plates 5 having an outer diameter substantially equal to or slightly smaller than the inner diameter of the bosses 4*a*, 4*b* are disposed on the rubber contacts 2*a* and 2*b*, respectively, with their top portions exposed outside the left and right bosses 4*a* and 4*b*.

Each of the rubber contacts 2*a* and 2*b* includes a disc-shaped contact portion 21 in contact with the corresponding pushing plate 5, a flared portion 22 formed integrally with an upper periphery of the contact portion 21, and a ring-shaped portion 23 formed integrally with a lower end of the flared portion 22, as shown in FIG. 3. Lower ends of the bosses 4*a*, 4*b* are pressed against the ring-shaped portions 23 to fix the rubber contacts 2*a* and 2*b* in the bosses 4*a*, 4*b* without position shift, respectively.

As illustrated in FIG. 3, a tubular boss 7 is integrally formed in an intermediate position between the bosses 4*a* and 4*b* on an upper surface of the case 3, and a spring 8 having a length greater than the height of the boss 7 is housed in the boss 7. A sliding element 9 having an outer diameter substantially equal to or slightly smaller than the inner diameter of the boss 7 is fitted in an upper portion of the boss 7, with an upper portion of the spring 8 being housed in a recessed groove 10 formed in a lower surface of the sliding element 9. The sliding element 9 has an upper outer surface processed into a curved configuration, and a key top 11 is placed on the sliding element 9.

The key top 11 includes a generally flat base portion 11*a*, a slidable-contact portion 11*b* bulging integrally downwardly from the center of a lower surface of the base portion 11*a* for slidable contact with an upper end portion of the sliding element 9, a groove 11*c* formed at the center of the slidable-contact portion 11*b* and releasably receiving the upper end portion of the sliding element 9, and peripheral side walls 11*d* formed integrally with front and rear peripheries of the base portion 11*a*. Although not shown in FIG. 3, the peripheral side walls 11*d* are supported by an outer surface of the boss 7 for rotation about a support shaft at their lower center, with the entire key top 11 pushed downwardly against the urging force of the spring 8. In operation, for example, when the key top 11 is pressed at its left end, the whole key top 11 rotates about the support shaft. Then the left end of the key top 11 moves downwardly, and the bottom of a left wall of the peripheral side walls 11*d* presses the corresponding pushing plate 5, which in turn deforms the rubber contact 2*a*. A disc-shaped conductor 12 applied to a lower surface of the contact portion 21 moves downwardly into contact with a conductive portion of the printed board 1, to close a switch contact. When the key top 11 is pressed at its right end, similar operation is carried out so that the rubber contact 2*b* is deformed.

This type of push button switch provides a satisfactory switch operating feeling if relation between stroke S and operational load F (F-S diagram) is represented by a curve having a pattern shown in FIG. 4. In the construction of FIG. 3, when the key top 11 is pressed at one end (left end) as shown in broken lines, the sliding element 9 slides in the groove 11*c*. Resiliency of the spring 8 when the sliding element 9 is removed from the groove 11*c* generates a peak load F2 shown in the F-S diagram of FIG. 4 to produce the operating feeling.

At this time, the actuating support 2*a* and 2*b* act only as contacts.

In the prior art construction shown in FIG. 3, however, the practical operating feeling is determined by composition of the reactive forces of the spring 8 and the rubber contacts 2*a*, 2*b*. This results in a plurality of factors determining the feeling, and it is accordingly difficult to provide a satisfactory operating feeling.

Further, the prior art construction comprises a large number of parts such as the spring 8 and the sliding element 9, resulting in increased costs and increased switch size.

SUMMARY OF THE INVENTION

According to the present invention, a push button switch comprises; a case in which a printed board is disposed, a key top to be pressed, the key top being mounted on the case for rotation about a support shaft, two tubular bosses formed in the case, and two rubber contacts housed respectively in the bosses and each deformed on receipt of pressure upon the key top through a pushing plate for closing a switch contact formed on the printed board, each of the rubber contacts including a contact portion having a top surface contacting the pushing plate and a bottom surface to which a conductor for closing the switch contact is applied; a flared portion formed integrally with the periphery of the contact portion, and a ring-shaped portion formed integrally with a lower end of the flared portion and disposed on the printed board, wherein the following relation is satisfied: $0.3 \leqq d/a \leqq 0.7$, $4 \leqq d/t \leqq 6$, $1.0 \leqq d/h \leqq 1.4$, $150° \leqq \theta \leqq 165°$, $1.5 \leqq h \leqq 3$ where t is the thickness of the flared portion, d is the length of the flared portion, a is an inner diameter of the ring-shaped portion, θ is an opening angle formed by an inner side surface of the flared portion and a top surface of the printed board, and h is the distance between a bottom surface of the conductor and the top surface of the printed board.

In the rubber contact according to the present invention including the contact portion, the flared portion, and the ring-shaped portion, the respective dimensions are set to the foregoing values, thereby providing a sufficient operational load and a clear click feeling required for the vehicle-mounted switch without using the conventional spring and sliding element. This accomplishes an inexpensive, small-sized vehicle-mounted push button switch.

It is an object of the present invention to provide a push button switch which includes a lesser number of parts and provides a satisfactory operating feeling only by rubber contacts.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
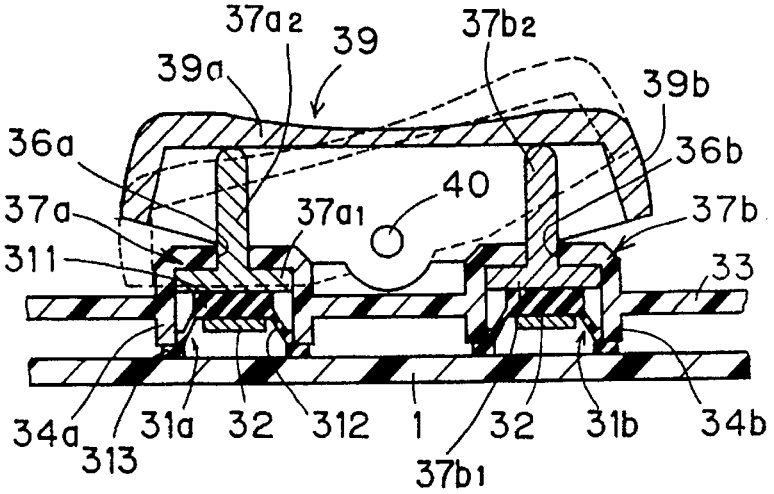
FIG. 1 is a front view in cross section of a preferred embodiment when in use according to the present invention.
Figure 2:
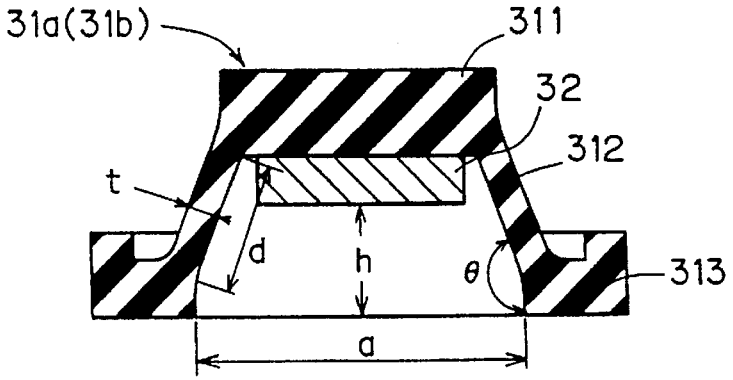
FIG. 2 is a fragmentary enlarged view of FIG. 1.
Figure 3:
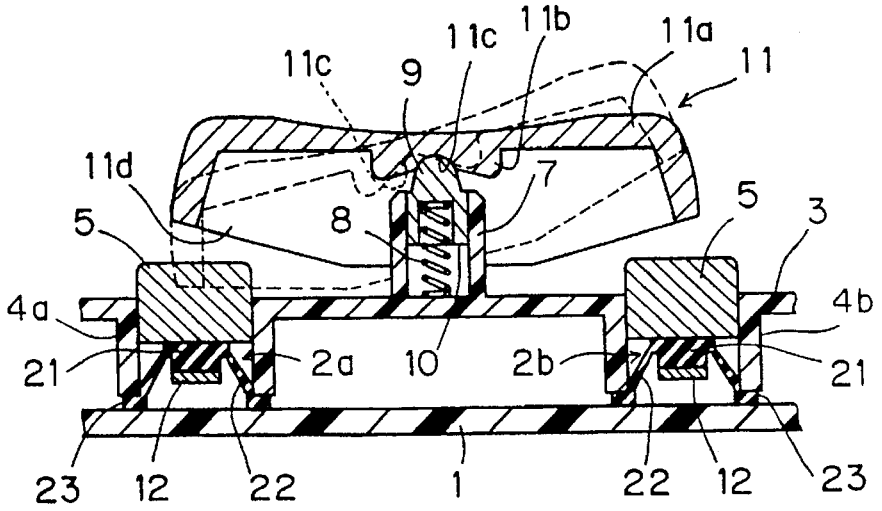
FIG. 3 is a front view in cross section of the prior art.

FIG. 1 is a front view in cross section of a preferred embodiment when in use according to the present invention. FIG. 2 is a fragmentary enlarged view of FIG. 1.

Referring now to FIG. 2, a rubber contact according to the present invention comprises a disc-shaped contact portion 311, a flared portion 312 formed integrally with a lower periphery of the contact portion 311, and a ring-shaped portion 313 formed integrally with a lower end of the flared portion 312. The rubber contact is made of silicone rubber having a 50 to 70 hardness (Japanese Industrial Standards; JIS A). A disc-shaped conductor 32 is applied to a lower surface of the contact portion 311.

Dimensions t, d, a, θ, h shown in FIG. 2 are set to satisfy: $0.3 \leqq d/a \leqq 0.7$, $4 \leqq d/t \leqq 6$, $1.0 \leqq d/h \leqq 1.4$, $150° \leqq \theta \leqq 165°$, $1.5 \leqq h \leqq 3$. This allows the rubber contact to have a peak load (F2) of 300 to 600 gf, a stroke (S2) of 1.5 to 3 mm, a click rate ((F2–F1)×100/F2) of 40 to 60%, and a click value (F2/S2) of not less than 130. Thus, a sufficient operational load for a vehicle-mounted switch, a long stroke, and a clear click feeling are provided.

A push button switch using the rubber contacts having the foregoing characteristics is formed as shown in FIG. 1. Two rubber actuating supports 31*a*, 31*b* shown in FIG. 2 are arranged laterally in position on a printed board 1. A case 33 includes left and right bosses 34*a*, 34*b* of tubular configuration with a closed top surface which are formed integrally in positions corresponding respectively to the actuating support 31*a*, 31*b*. The case 33 is disposed on the printed board 1 so that the actuating supports 31*a*, 31*b* are positioned within the bosses 34*a*, 34*b*, respectively. An upper half of each of the bosses 34*a*, 34*b* projects upwardly so that it is higher than a top surface of the case 33.

Lower ends of the bosses 34*a*, 34*b* are pressed against the ring-shaped portions 313 of the rubber contacts 31*a*, 31*b* to fix the actuating supports 31*a*, 31*b* in the bosses 34*a*, 34*b* without position shift, respectively.

Referring to FIG. 1, through holes 36*a*, 36*b* are formed at the center of top walls of the bosses 34*a*, 34*b*, respectively. Disc-shaped base plate portions 37*a*1, 37*b*1 of pushing plates 37*a*, 37*b* are housed in the bosses 34*a*, 34*b* on the actuating supports 31*a*, 31*b*, respectively. Pole portions 37*a*2, 37*b*2 extending vertically and formed integrally with and centrally of the base plate portions 37*a*1, 37*b*1 are introduced outwardly of the bosses 34*a*, 34*b* through the through holes 36*a*, 36*b*, respectively.

A key top 39 including a generally flat base portion 39*a* and peripheral side walls 39*b* formed integrally with front and rear peripheries of the base portion 39*a* is placed over the pole portions 37*a*2, 37*b*2 of the pushing plates 37*a*, 37*b* as shown in FIG. 1. A support shaft 40 extending in backward and forward directions is formed in an intermediate position between the bosses 34*a* and 34*b* on an upper surface of the case 33. The peripheral side walls 39*b* of the key top 39 are rotatably supported at their lower center by the support shaft 40. In operation, for example, when the key top 39 is pressed at its left end, the whole key top 39 rotates about the support shaft 40. Then the left end of the key top 39 is moved downwardly, and the left portion of the bottom face of the base portion 39*a* presses the pole portion 37*a*2 of the pushing plate 37*a*, which in turn deforms the rubber contact 31*a*. The conductor 32 on the lower surface of the corresponding contact portion 311 is brought into contact with the printed board 1, thereby to close a switch contact. When the key top 39 is pressed at its right end, similar operation is carded out so that the rubber contact 31*b* is deformed.

Figure 4:
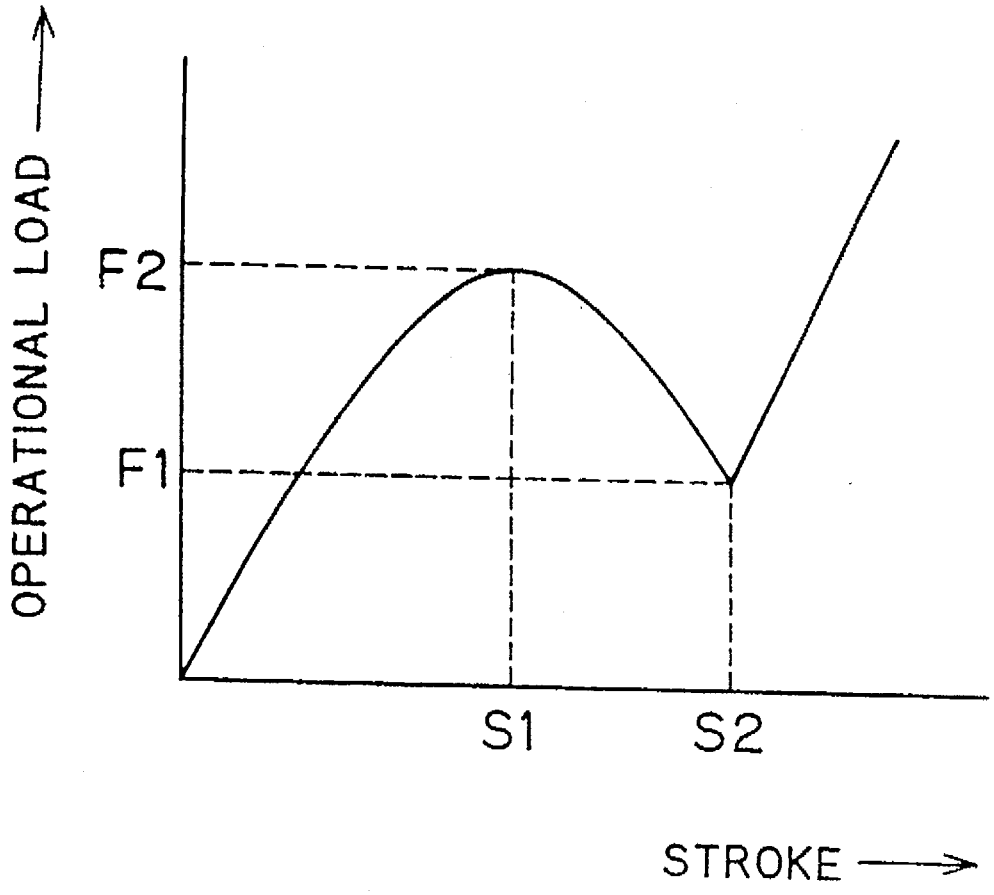
FIG. 4 illustrates relation between stroke and operational load which represents an operating feeling of a common switch.

In the actuating support 31*a*, 31*b* shown in FIGS. 1 and 2, the operating feeling is determined by the configuration and material of the flared portion 312. As the wall thickness t of the flared portion 312 increases or the hardness of a rubber contact material increases, the peak load F2 increases in the F-S diagram of FIG. 4. On the other hand, as the peak load increases, operational durability tends to decrease. In order to provide operational load and stroke suitable for the vehicle-mounted switch and a clear click feeling, the respective dimensions t, d, a, θ, h of the actuating supports 31*a*, 31*b* of FIG. 2 are set, as above described, to satisfy: $0.3 \leqq d/a \leqq 0.7$, $4 \leqq d/t \leqq 6$, $1.0 \leqq d/h \leqq 1.4$, $150° \leqq \theta \leqq 165°$, $1.5 \leqq h \leqq 3$, and silicone rubber having a 50 to 70 hardness (Japanese Industrial Standards; JIS A) is used. This provides a peak load of 300 to 600 gf, a stroke of 1.5 to 3 mm, a click rate of 40 to 60%, and a click value of not less than 130. Preferable characteristics of the rubber contacts for the vehicle-mounted switch are accomplished in this manner.

The actuating supports 31*a*, 31*b* only can provide a sufficient operational load and a clear click feeling required for the vehicle-mounted switch without using other parts such as the conventional spring and sliding element in combination therewith.

It should be noted that the material of the actuating supports 31*a*, 31*b* is not limited to silicone rubber described above.

While the invention has been shown and described in detail, the foregoing description is in all aspects illustrative and not restrictive. It is therefore understood that numerous modifications and variations can be devised without departing from the scope of the invention.

What is claimed is:

1. A push button switch comprising a printed circuit board having two switch contacts thereon, a pair of conductors, corresponding to said switch contacts, adapted for movement in a direction into and out of contact with said switch contacts, said conductors being mounted on bottom surfaces of a corresponding pair of actuating supports, each of said actuating supports being movable in said direction within a tubular boss, a key top, rotatably mounted on a support shaft having its axis perpendicular to said direction, adapted for movement between a neutral position, wherein both of said conductors are out of contact with said switch contacts, and either a first position, wherein said key top causes one of said conductors to move in said direction to contact one of said switch contacts, or a second position, wherein said key top causes another of said conductors to move in said direction to contact another of said switch contacts, said supports having flared portions integral with peripheries of said bottom surfaces, said flared portions adapted to deform as said key top exerts pressure on said actuating supports, said switch satisfying the following relations: $0.3 \leqq d/a \leqq 0.7$, $4 \leqq d/t \leqq 6$, $1.0 \leqq d/h \leqq 1.4$, $150° \leqq \theta \leqq 165°$, $1.5 \leqq h \leqq 3$ where t is the thickness of said flared portion, d is the length of said flared portion, a is an inner diameter of said flared portion, θ is an opening angle formed by an inner side surface of said flared portion and a top surface of said printed board, and h is the distance between a bottom surface of said conductor and the top surface of said printed board.

2. The switch of claim 1 wherein said actuating supports have top surfaces and further including pushing plates in contact with said top surfaces and said key top, whereby pressure exerted by said key top is transmitted by said pushing plates through said actuating supports to said conductors.

3. The switch of claim 1 wherein a ring shaped portion is integral with a lower end of said flared portion.

4. The switch of claim 1 wherein said actuating supports are of silicone rubber.

5. The switch of claim 1 wherein there is a case which surrounds and encloses said circuit board.

* * * * *